US005145399A

United States Patent [19]

Davenport

[11] Patent Number: 5,145,399

[45] Date of Patent: Sep. 8, 1992

[54] CABLE LOCK APPARATUS

[76] Inventor: Kenneth S. Davenport, 4009 Red Coat La., Greensboro, N.C. 27410

[21] Appl. No.: 745,142

[22] Filed: Aug. 15, 1991

[51] Int. Cl.[5] ..... H01R 13/62

[52] U.S. Cl. ..... 439/371; 439/373; 439/367

[58] Field of Search ..... 439/367-370, 439/371, 373, 451

[56] References Cited

U.S. PATENT DOCUMENTS

| | | | |
|---|---|---|---|
| 2,569,037 | 9/1951 | Dalton | 439/373 |
| 2,659,059 | 11/1953 | Johnson | 439/373 |
| 3,571,782 | 3/1971 | Colbert | 439/367 |
| 4,247,743 | 1/1981 | Hinton et al. | 439/371 |
| 4,789,353 | 12/1988 | Busta et al. | 439/373 |

*Primary Examiner*—Larry I. Schwartz
*Assistant Examiner*—Hien D. Vu
*Attorney, Agent, or Firm*—Leon Gilden

[57] ABSTRACT

An apparatus includes a mechanism to lock electric cable such as utilized in electric guitars and the like to the guitar and the associated amplifier. A mounting bracket includes a mounting plate pivotally mounting a support leg. The support leg mounts an abutment sleeve, wherein the abutment sleeve mounted to the support leg is positioned in abutment to a cable boss mounted to a cable plug of an associated cable. A modification of the invention includes a resilient bumper ring mounted coextensively and to a forward end of the abutment sleeve.

6 Claims, 4 Drawing Sheets

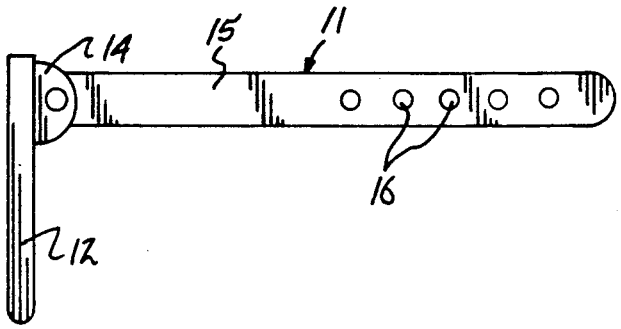
Fig 1
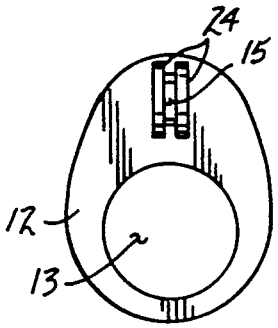
Fig 2
Fig 3
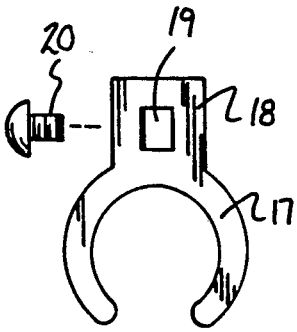
Fig 4
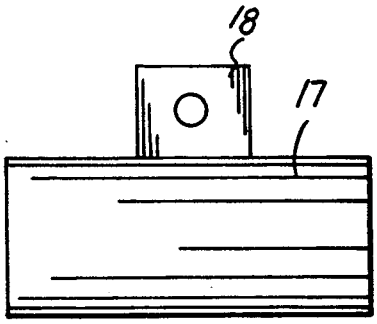

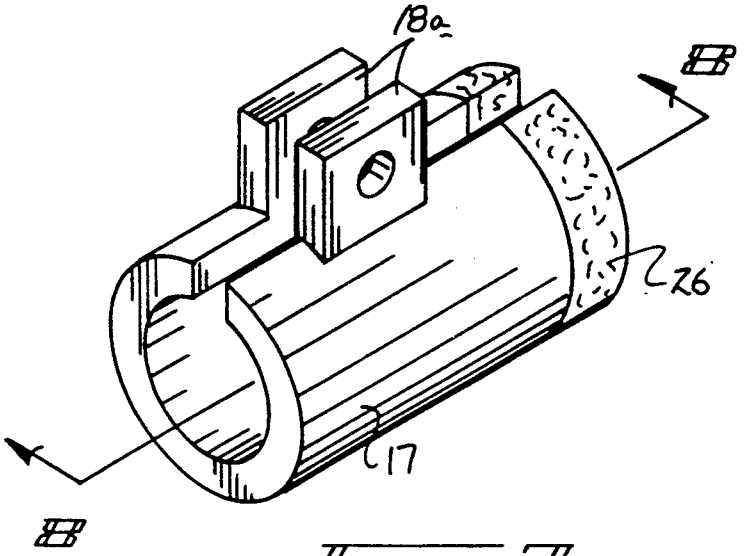
Fig 7
Fig 8
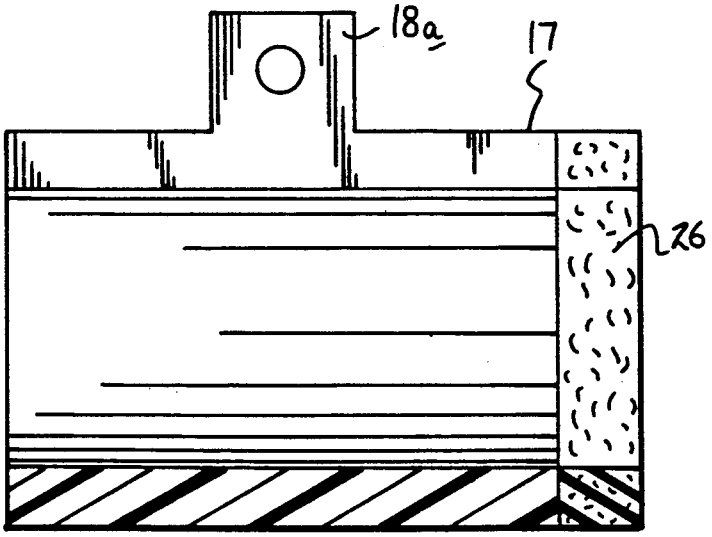

CABLE LOCK APPARATUS

BACKGROUND OF THE INVENTION

1. Field of the Invention

The field of invention relates to electrical musical instruments, and more particularly pertains to a new and improved cable lock apparatus wherein the same is utilized with musical instruments to lock an associated cable in communication with an amplifier and the like relative to the musical instrument.

2. Description of the Prior Art

When utilizing coaxial type cable to be mounted within musical instruments and the like, the cables are subject to removal relative to the socket of the instrument or amplifier. The invention sets forth an organization to effectively latch the cable relative to the instrument.

Prior art structure illustrating musical amplification apparatus is set forth and exemplified in U.S. Pat. No. 4,428,268 to Ingoglia setting forth a guitar with an amplification system mounting ear phones and the like for use by an individual.

U.S. Pat. No. 3,680,423 to Lander sets forth a combined drum and guitar musical instrument associated with a respective amplifier mechanism.

U.S. Pat. No. 3,868,880 to Chapman sets forth a musical instrument utilizing electrical amplification.

As such, it may be appreciated that there continues to be a need for a new and improved cable lock apparatus as set forth by the instant invention which addresses both the problems of ease of use as well as effectiveness in construction in the securement of a coaxial type cable relative to a musical instrument and in this respect, the present invention substantially fulfills this need.

SUMMARY OF THE INVENTION

In view of the foregoing disadvantages inherent in the known types of cable apparatus now present in the prior art, the present invention provides a cable lock apparatus wherein the same is arranged for locking a cable relative to a musical instrument. As such, the general purpose of the present invention, which will be described subsequently in greater detail, is to provide a new and improved cable lock apparatus which has all the advantages of the prior art cable apparatus and none of the disadvantages.

To attain this, the present invention provides an apparatus including a mechanism to lock electric cable such as utilized in electric guitars and the like to the guitar and the associated amplifier. A mounting bracket includes a mounting plate pivotally mounting a support leg. The support leg mounts an abutment sleeve, wherein the abutment sleeve mounted to the support leg is positioned in abutment to a cable boss mounted to a cable plug of an associated cable. A modification of the invention includes a resilient bumper ring mounted coextensively and to a forward end of the abutment sleeve.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cable lock apparatus which has all the advantages of the prior art cable apparatus and none of the disadvantages.

It is another object of the present invention to provide a new and improved cable lock apparatus which may be easily and efficiently manufactured and marketed.

It is a further object of the present invention to provide a new and improved cable lock apparatus which is of a durable and reliable construction.

An even further object of the present invention is to provide a new and improved cable lock apparatus which is susceptible of a low cost of manufacture with regard to both materials and labor, and which accordingly is then susceptible of low prices of sale to the consuming public, thereby making such cable lock apparatus economically available to the buying public.

Still yet another object of the present invention is to provide a new and improved cable lock apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic side view of the mounting bracket utilized by the invention.

FIG. 2 is an orthographic top view of the bracket, as illustrated in FIG. 1.

FIG. 3 is an orthographic end view of the abutment sleeve utilized by the instant invention.

FIG. 4 is an orthographic side view of the abutment sleeve utilized by the invention.

FIG. 7 is an isometric illustration of a modified abutment sleeve.

FIG. 8 is an orthographic view, taken along the lines 8—8 of FIG. 7 in the direction indicated by the arrows.

DESCRIPTION OF THE PREFERRED EMBODIMENT

Figure 5:
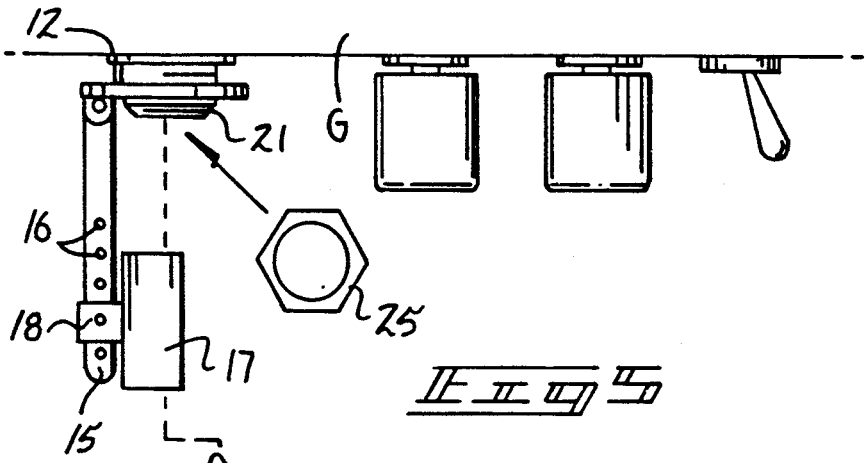
FIG. 5 is an orthographic view of the apparatus mounting a cable relative to a socket.
Figure 6:
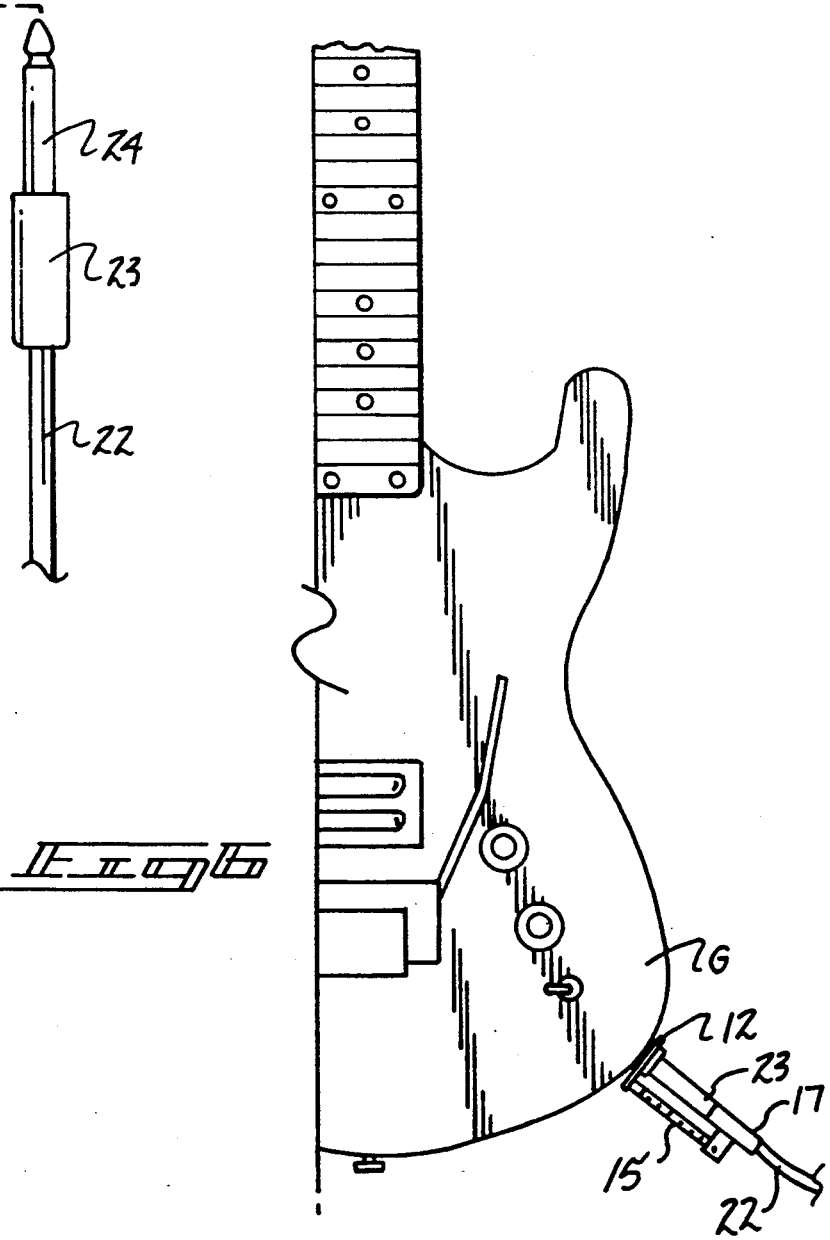
FIG. 6 is an orthographic top view of the organization mounted to a musical instrument.

With reference now to the drawings, and in particular to FIGS. 1 to 10 thereof, a new and improved cable lock apparatus embodying the principles and concepts of the present invention and generally designated by the reference numeral 10 will be described.

More specifically, the cable lock apparatus 10 of the instant invention essentially comprises a mounting bracket 11 for securement to a cable socket 21, as illustrated in FIG. 5, wherein the mounting bracket 11 includes an attachment plate 12. The attachment plate 12 includes an attachment plate bore 13 directed therethrough to receive the cable socket 21 therewithin. Spaced flanges 14 are orthogonally mounted to a top surface of the attachment plate 12 to pivotally mount a support leg 15 therebetween at a forward end of the support leg. The support leg includes a plurality of spaced support leg bores 16 directed along the support leg for selective and adjustable mounting of an abutment sleeve 17 thereon. The abutment sleeve defines a discontinuous cylinder defining arc substantially greater than one hundred eighty degrees. An abutment sleeve boss 18 is mounted thereon that includes a boss bore 19 therethrough, wherein the boss bore 19 receives the support leg 15 therethrough. The boss bore 19 receives a fastener 20 orthogonally through the boss bore wherein the fastener is directed simultaneously through the support leg bore 16 to thereby adjustably mount the abutment sleeve along the leg 15. In this manner, a cable 22 that includes a cable boss 23 is mounted forwardly of the abutment sleeve 17 to thereby secure the cable boss 23 between a forward end of the abutment sleeve and the cable socket 21. A cable plug 24 is received within the socket, with a lock nut 25 secured about an externally threaded cable socket 21 to thereby secure the attachment plate 12.

Figure 9:
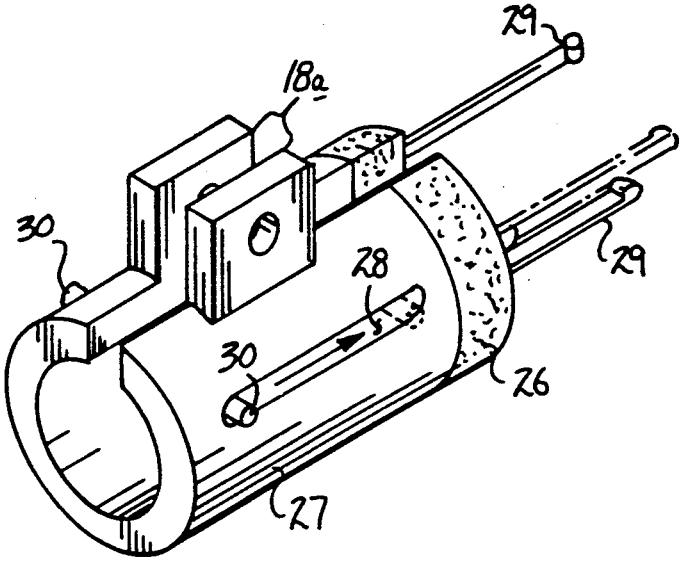
FIG. 9 is an isometric illustration of a further modified abutment sleeve utilized by the invention.
Figure 10:
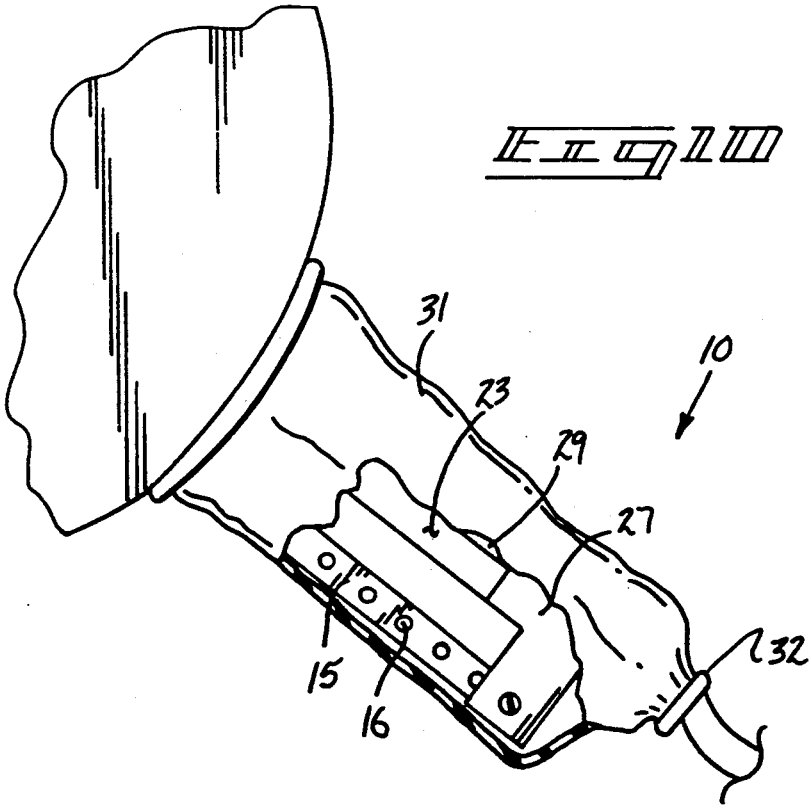
FIG. 10 is an orthographic fragmentary view of the apparatus mounted to a musical instrument in cooperation with a fluid impermeable sheath.

FIG. 7 illustrates a modified abutment sleeve 17 that includes a plurality of spaced parallel boss flanges 18*a* that includes the boss bore orthogonally through the boss flanges receiving the fastener therethrough to mount to the support leg 15, in a manner as described above. A resilient split bumper ring 26 is mounted coextensively of the abutment sleeve 17 at a forward end thereof into engagement with a rear end portion of the boss 23 to provide biasing of the cable boss into the socket to enhance securement thereof. Further, a modified sleeve construction 27, as illustrated in FIG. 9, is arranged to include slots 28 directed longitudinally of the cylindrical walls of the sleeve 27, wherein the slots 28 each including a projection 30 directed therethrough, wherein the projections 30 are orthogonally mounted to alignment legs 29 that are retractably mounted relative to the sleeve that are projectable relative to the sleeve in encompassing relationship relative to the cable boss 23 to enhance securement thereof. Finally, a fluid impermeable sheath 31 is optionally provided, including a resilient neck 32 for securement rearwardly of the sleeve 17 for surrounding relationship relative to the sleeve and associated mounting bracket 11 to provide a shield to prevent moisture and dust, debris, and the like from entering the connection between the cable socket 21 and the associated cable plug 24.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cable lock apparatus for mounting a cable plug within a cable socket, the cable plug including a cable boss mounted to the cable plug, with a cable extending rearwardly of the cable boss, the apparatus comprising, an attachment plate, the attachment plate including an attachment plate bore, the attachment plate bore receiving the cable socket therethrough, and a support leg mounted to the attachment plate, the support leg including an abutment sleeve mounted to the support leg, and the abutment sleeve positioned along the support leg above the attachment plate bore and in abutment with the cable boss when the cable plug is positioned within the cable socket, and the attachment plate includes a plurality of spaced flanges orthogonally and fixedly mounted to a top surface of the attachment plate adjacent the attachment plate bore, wherein the support leg is pivotally mounted between the spaced flanges, the support leg including a plurality of support leg bores spaced along the support leg, and the abutment sleeve including an abutment sleeve boss member, the abutment sleeve boss member including at least one boss bore directed therethrough, and a fastener directed through the at least one boss bore, and one of said support leg bores to secure the abutment sleeve to the support leg.

2. An apparatus as set forth in claim 1 wherein the abutment sleeve defines a discontinuous cylinder defining an angle of arc greater than one hundered eighty degrees.

3. An apparatus as set forth in claim 2 wherein the abutment sleeve boss member includes a plurality of spaced boss flanges to receive the support leg therebetween, the boss flanges include the at least one boss bore and a further boss bore directed in coaxial alignment relative to one another to receive the fastener therethrough, wherein the fastener is directed through the boss flanges and at least one of said support leg bores.

4. An apparatus as set forth in claim 3 wherein the abutment sleeve includes a resilient bumper ring mounted coextensively and coaxially of the abutment sleeve at a forward end thereof in confrontation with the attachment plate and spaced above the attachment plate.

5. An apparatus as set forth in claim 4 wherein the abutment sleeve includes a plurality of slots, the slots are arranged parallel relative to one another directed through the abutment sleeve, and each slot of the said slots includes a projection directed slidably therethrough, each projection is orthogonally and fixedly mounted to a rear terminal end of an alignment leg, each alignment leg is selectively projected forwardly of the abutment sleeve to encompass the boss therebetween.

6. An apparatus as set forth in claim 5 further including a fluid impermeable sheath mounted in surrounding relationship relative to the abutment sleeve and mounting bracket, including a resilient neck for securement about the cable rearwardly of the abutment sleeve.

* * * * *